US007992346B2

(12) United States Patent
Finke

(10) Patent No.: US 7,992,346 B2
(45) Date of Patent: Aug. 9, 2011

(54) SLIDING DOOR SYSTEM HAVING A LOCKING MECHANISM

(75) Inventor: Andreas Finke, Gevelsberg (DE)

(73) Assignee: Dorma GmbH & Co., KG, Ennepetal (DE)

( * ) Notice: Subject to any disclaimer, the term of this patent is extended or adjusted under 35 U.S.C. 154(b) by 818 days.

(21) Appl. No.: 11/596,420

(22) PCT Filed: May 10, 2005

(86) PCT No.: PCT/EP2005/005015

§ 371 (c)(1),
(2), (4) Date: Nov. 10, 2006

(87) PCT Pub. No.: WO2005/111356

PCT Pub. Date: Nov. 24, 2005

(65) Prior Publication Data

US 2007/0180772 A1 Aug. 9, 2007

(30) Foreign Application Priority Data

May 12, 2004 (DE) ..... 10 2004 023 927

(51) Int. Cl.
*E05F 17/00* (2006.01)

(52) U.S. Cl. ..... 49/123; 49/370; 49/360; 49/118; 49/449; 188/31

(58) Field of Classification Search ..... 49/123, 49/118, 120, 366, 370, 409, 404, 360, 449; 188/31

See application file for complete search history.

(56) References Cited

U.S. PATENT DOCUMENTS

| | | | | |
|---|---|---|---|---|
| 1,190,811 | A * | 7/1916 | Swoyer et al. | 188/31 |
| 1,928,611 | A * | 10/1933 | Bancroft | 49/138 |
| 4,223,775 | A * | 9/1980 | Lloyd | 477/172 |
| 4,313,281 | A * | 2/1982 | Richmond | 49/280 |
| 4,330,960 | A * | 5/1982 | Hasemann et al. | 49/404 |
| 4,402,503 | A * | 9/1983 | Galbierz | 482/5 |

(Continued)

FOREIGN PATENT DOCUMENTS

DE 44 15 708 7/1995

(Continued)

OTHER PUBLICATIONS

Search Report dated Jul. 25, 2005 for the underlying International Application No. PCT/EP2005/005015.

*Primary Examiner* — Gregory J. Strimbu
(74) *Attorney, Agent, or Firm* — Cohen Pontani Lieberman & Pavane LLP

(57) ABSTRACT

A drive device for a sliding door system having a transom and at least one door leaf guided along the transom. The drive device includes: a housing which can be mounted on the transom; a pulley which can be driven in rotation by a drive, the pulley being mounted for rotation on the housing and having a flange with locking elements adjacent to the housing; an endless traction mechanism guided around the pulley for moving the at least one door leaf linked to the traction mechanism; complementary locking elements which can be moved relative to the housing to engage the locking elements on the flange and thereby prevent rotation of the pulley; and an electromechanical actuation device which moves the complementary locking elements in response to an impulse emitted by a locking control.

19 Claims, 3 Drawing Sheets

U.S. PATENT DOCUMENTS

| | | | | |
|---|---|---|---|---|
| 4,605,108 | A * | 8/1986 | Monot | 477/8 |
| 5,992,919 | A * | 11/1999 | Menke | 296/155 |
| 6,198,242 | B1 * | 3/2001 | Yokomori et al. | 318/445 |
| 7,003,915 | B2 * | 2/2006 | Yokomori | 49/360 |
| 7,407,233 | B2 * | 8/2008 | McCann et al. | 303/89 |
| 2001/0013200 | A1 * | 8/2001 | Fink | 49/120 |
| 2002/0157317 | A1 | 10/2002 | Valencia et al. | |
| 2005/0039405 | A1 * | 2/2005 | Yokomori | 49/360 |

FOREIGN PATENT DOCUMENTS

| | | |
|---|---|---|
| DE | 197 00 859 | 7/1998 |
| DE | 100 38 867 | 2/2002 |

* cited by examiner

SLIDING DOOR SYSTEM HAVING A LOCKING MECHANISM

CROSS-REFERENCE TO RELATED APPLICATIONS

This is a U.S. national stage of International Application No. PCT/EP2005/005015, filed on 10 May 2005. Priority is claimed on German Application No. 10 2004 023 927.4, filed on 12 May 2004.

BACKGROUND OF THE INVENTION

1. Field of the Invention

The invention relates to a sliding door system including a drive device disposed in a transom for at least one door leaf; an electromechanical actuation device for locking the at least one door leaf relative to the transom; and an endless traction means guided by a driven pulley of the drive device and tension-resistantly connected to the at least one door leaf.

SUMMARY OF THE INVENTION

Generally, sliding door systems of the species mentioned above are automatic doors substantially consisting of glass, the opening operation being effected through an electrical impulse picked up by a drive device, the closing operation being automatically carried out with a time delay. Moreover, the ability to firmly lock one or more door leaves is required with the door being open and being closed as well. In addition to manually actuated locking systems, automatically engaging locking systems are used. The invention is based on this type of locking system. In particular, when locking a closed door, it is imperative to guarantee that no opening gap remains between adjoining door leaves.

In DE 44 15 708 C1 a locking system for the drive of a sliding door is described, wherein a tappet cooperates non-positively and positively with a continuous toothed belt. The tappet has a cam, which cooperates with a hook-shaped locking system. On the one hand, the locking hook is actuated via the cam, which travels over a releasing catch, and on the other hand via the strand of the drive belt.

2. Description of the Related Art

An object of the invention is to improve the response characteristics of the locking system for a sliding door system of the species mentioned above, i.e. it is intended that the locking can be performed effectively even after the sliding door has been displaced over a very short distance only, and the locking system should not consist of a rod locking system.

The invention solves the given problem with a sliding door system comprising: a transom; at least one door leaf movable along the transom; an endless traction mechanism tension-resistantly connected to the at least one door leaf; a housing supported by the transom; a drive device for driving the endless traction mechanism, the drive device comprising a driven pulley supported by the housing and guiding the endless traction mechanism, the driven pulley having a flange facing the housing, and a locking element on the flange; a complementary locking element supported by the housing; and an electromechanical actuation device received in the housing, wherein the electromechanical actuation device is operable to cause the complementary locking element to abut against the locking element to lock the at least one door leaf relative to the transom.

Preferably, the locking components disposed at a flange of a driven pulley may be integral part of the flange or they may be disposed at an additional plate placed onto the flange, thus facilitating exchangeability. Generally, they may have an arbitrary form, as long as they are complementary to the locking components disposed at the housing. It is essential that the disposition of the components be chosen such that, in accordance with an impulse emitted by the locking control, the electromechanical actuation device is able to bring them into engagement or disengagement already after having travelled a very short displacement distance.

According to a preferred exemplary embodiment of the invention, the locking components of the flange consist of a toothing disposed at a surface adjoining the housing, whereas the locking components, which are locatable at the toothing of the flange of the driven pulley and bear on the housing, consist of a mating toothing disposed on a toothed disc. In such an embodiment, in accordance with the impulse of the locking control, the toothings opposite each other can directly engage one another, i.e. the locking system is very accurately responsive, which is particularly important, if the driven pulley is formed as a disc for a toothed belt in a generally known manner, such as to eliminate a relative sliding movement of the endless traction means in relation to the driven pulley.

In a further development of the invention, the toothed disc is supported at the housing by means of compression springs such that, by charging a locking bolt, which is supported in the housing and displaceable by means of a push rod of the electromechanical actuation device, the toothed disc is locatable at the flange of the driven pulley, against the force of the spring. This means practically that the compression springs press the toothed disc constantly into a demeshing position, i.e. into an unlocking position of the door leaves, which is particularly important in conjunction with using a stable electromagnet for actuating so-called emergency exit doors.

The above described arrangement of the toothed disc, on the one hand, and of the driven pulley of the drive device, on the other hand, in their demeshed position is selected such that, with the door leaf being unlocked, the toothed disc bears on an exterior side of an outside wall of the housing while leaving a gap between the mating toothing of the toothed disc and the toothing of the flange of the driven pulley. Practically, the size of the gap measuring about five to ten millimetres has been proven to be appropriate.

As a constructive embodiment of the invention, it is proposed to distance-invariably connect the toothed disc to a thrust plate supported in the housing by means of several connecting tenons, which displaceably pass through the outside wall of the housing, one or more compression springs being disposed between the thrust plate and the inside walling of the outside wall, which springs may be formed as coil springs surrounding respective connecting tenons or, as an alternative, as disc springs or leaf springs restrained between the thrust plate and the inside walling of the outside wall.

The above mentioned features allow for cooperation between the proper locking device and a push-rod rod of the electromagnetic actuation device.

According to a particular exemplary embodiment, it is proposed that the push-rod of the electromagnetic actuation device, tension and compression-resistantly, be connected to a locking bolt extending coaxially in relation to the push-rod, and that devices be disposed at the locking bolt and at the thrust plate for transforming the axial movement of the locking bolt into a movement of the thrust plate orthogonally oriented to the former. This measure allows for achieving a reversed direction of movement of the locking bolt, such that the force exerted onto the locking bolt will be transferred, via the thrust plate, onto the toothing or the mating toothing.

In an advantageous constructive embodiment of the invention, the above mentioned device at the locking bolt consists of a recess having a slide ramp, into which a slide block, being stationary disposed at the thrust plate and having a corresponding slide ramp, engages, if the door leaf is unlocked. The above mentioned feature constitutes a simple technical solution for reversing the direction of movement of the locking bolt.

Basically, the inventive device can be operated in that the electromagnetic actuation device comprises a bistable magnet, which, in accordance with the respective impulse, is able to mesh or to demesh the locking device. In order to guarantee a so-called fail-safe function, according to an embodiment of the invention, a stable electromagnet is used, which only triggers the locking position electromagnetically, whereas the unlocking position—for example in the event of a power failure—is spring operated.

Furthermore, when applied with so-called emergency exit doors, the invention is characterized in that, when using a normal electromagnet for the electromagnetical actuation of the push-rod, a spring, which urges the locking bolt back into the unlocking position, if the electromagnet is de-energized, is disposed between the housing and the locking bolt.

BRIEF DESCRIPTION OF THE DRAWINGS

The invention will now be explained in more detail, based on one diagrammatically illustrated exemplary embodiment, in which.

DETAILED DESCRIPTION OF THE PRESENTLY PREFERRED EMBODIMENTS

Figure 1:
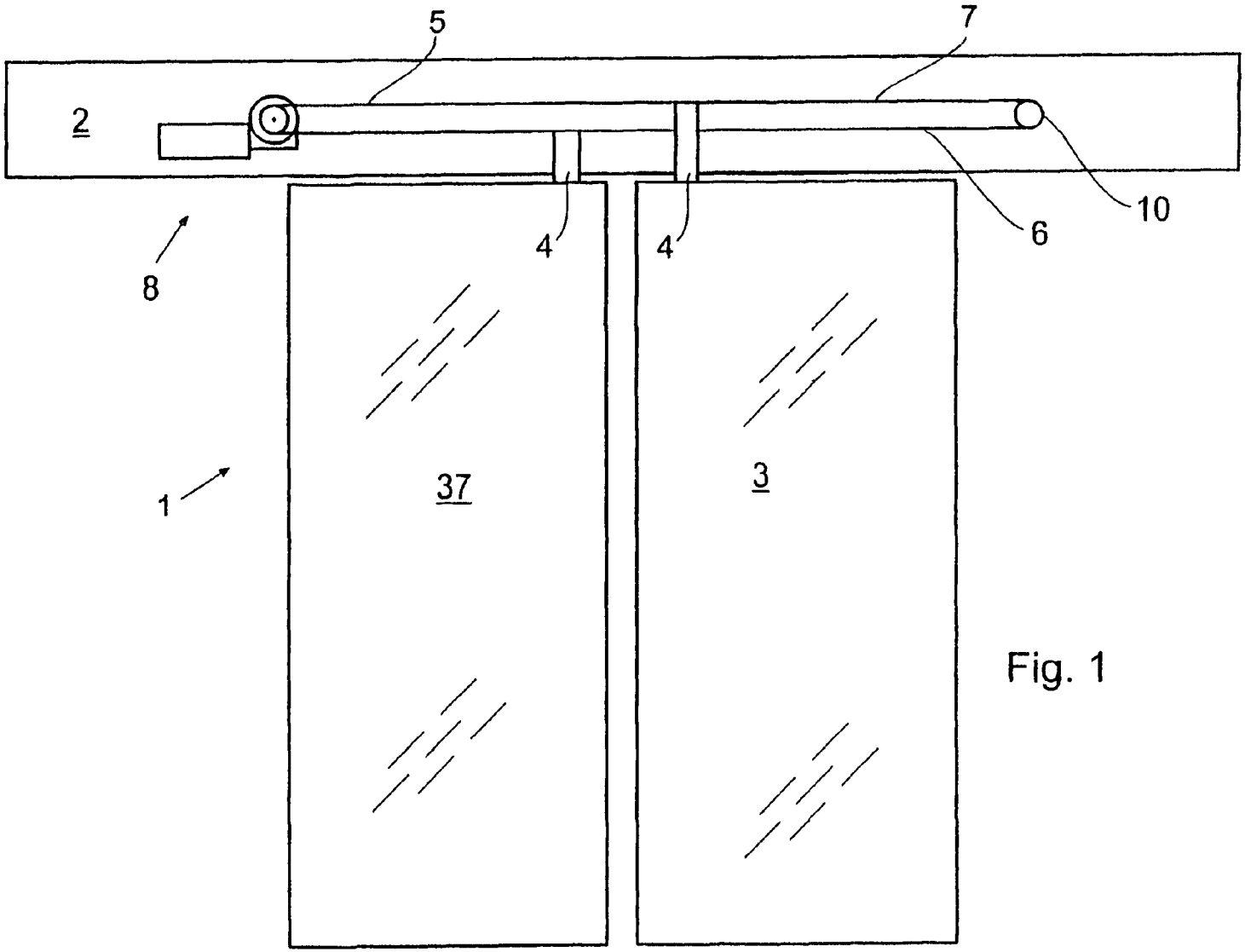
FIG. 1 shows a diagrammatic view of a sliding door system.

According to FIG. 1, a sliding door system 1 substantially consists of two door leaves 3, 37 which are guided along a roller rail (not illustrated) of a transom 2 and which are connected to an endless traction mechanism 7 by means of a connecting member 4. In order to achieve an opposing movement of the door leaves 3, 37, one connecting member 4 of the door leaf 3 is connected to an upper strand 5 and one connecting member 4 of the door leaf 37 is connected to a lower strand 6 of the endless traction mechanism 7. A drive, driving the endless traction mechanism 7, is identified by reference 8.

Figure 2:
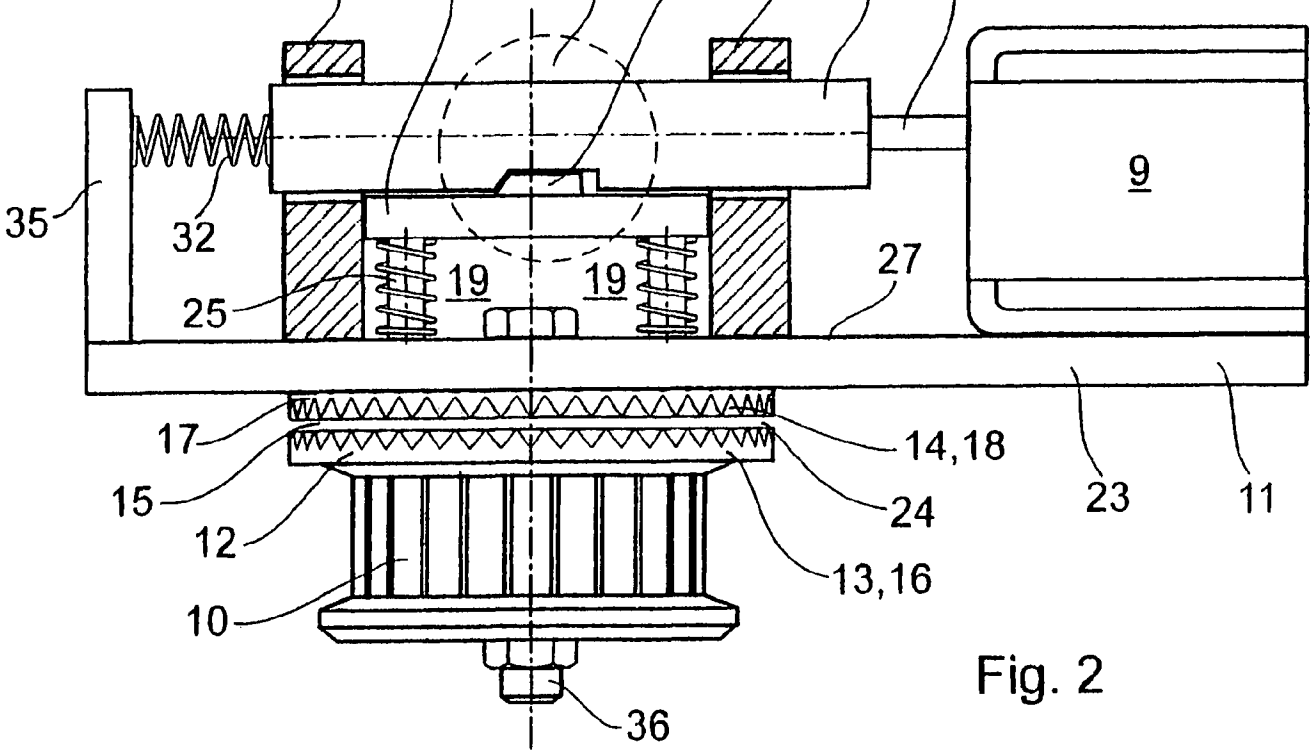
FIG. 2 shows a partial horizontal section through the housing with locking elements.
Figure 3:
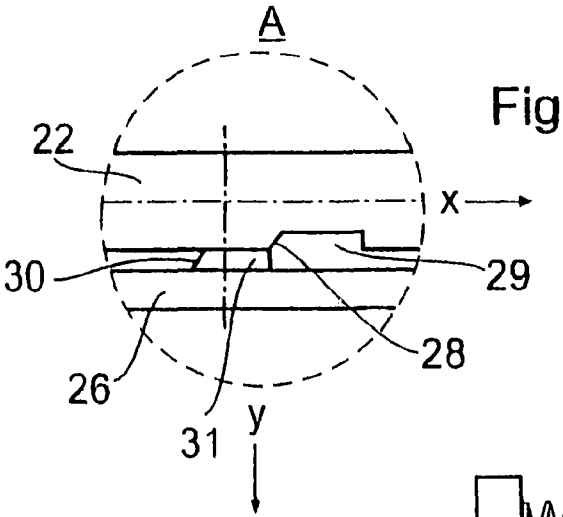
FIG. 3 shows detail A according to FIG. 2.

According to FIGS. 2 and 3, a driven pulley 10, which has teeth for engaging an endless belt, forms an integral part of the drive 8 and is the last transmission member of the drive 8. An electromagnetic actuation device is identified by 9. By means of a screw connection 36, the driven pulley 10 is supported at a housing 11, which is connected to the transom 2 via a mounting plate 34. At the side adjacent the housing 11, the driven pulley 10 has a flange 12 at which locking elements 13 are disposed, which are formed as a toothing 16 in the exemplary embodiment. A toothed disc 17, which in turn has locking elements 14 formed as a mating toothing 18, is disposed opposite the toothing 16. The toothing 16 of the flange 12 is disposed at a surface 15 of the flange 12, which surface is adjacent the housing 11.

The toothed disc 17 is secured to a thrust plate 26 within the housing 11 via connecting tenons 25, which displaceably pass through an outside wall 23 of the housing 11. On the one side, compression springs 19 in FIG. 2 abut against the thrust plate 26 and, on the other side, against an inside surface 27 of the outside wall 23, thus maintaining the toothed disc 17 in the position illustrated in FIG. 2. In this case, a gap 24 remains between the toothed disc 17 and the flange 12 of the driven pulley 10, i.e. the door leaf or the door leaves 3, 37 are in an unlocked position.

A locking bolt 22, which is displaceably supported in guiding flanges 33 of the housing 11, in a tension and compression-resistant manner, is coaxially connected to the push-rod 21 of the electromechanical actuation device 9. According to FIG. 2, a slide block 31 stationary disposed at the thrust plate 26 (see FIG. 3) is located in a recess 29 of the locking bolt 22. When charging the electromagnetic actuation device 9 and moving the push-rod 21 in the direction of arrow X, the thrust plate 26, as a result, is displaced in the direction of arrow Y, as illustrated in FIG. 3, i.e. the mating toothing 18 of the toothed disc 17 engages in the toothing 16 of the flange 12. In this case, a corresponding slide ramp 30 of the slide block 31 slides over a complementary slide ramp 28 of the recess 29 and moves the thrust plate 26 into the direction of arrow Y against the force of the compression spring 19.

A spring 32, illustrated in FIG. 2, is only required when using the device in conjunction with emergency exit or fire rated doors; in this case, it is assumed that the electromagnetic actuation device 9 has a magnet, which only effects the locking action, such that the spring 32, formed as a tension spring, urges the push-rod 21, and thus the locking bolt 22, back into the position illustrated in FIG. 2. In this case, the tension spring 32 may abut against a front plate 35 of the housing 11. In addition to using different magnet types for the electromagnetic actuation device 9, as described, obviously an electric motor may be used.

Figure 4:
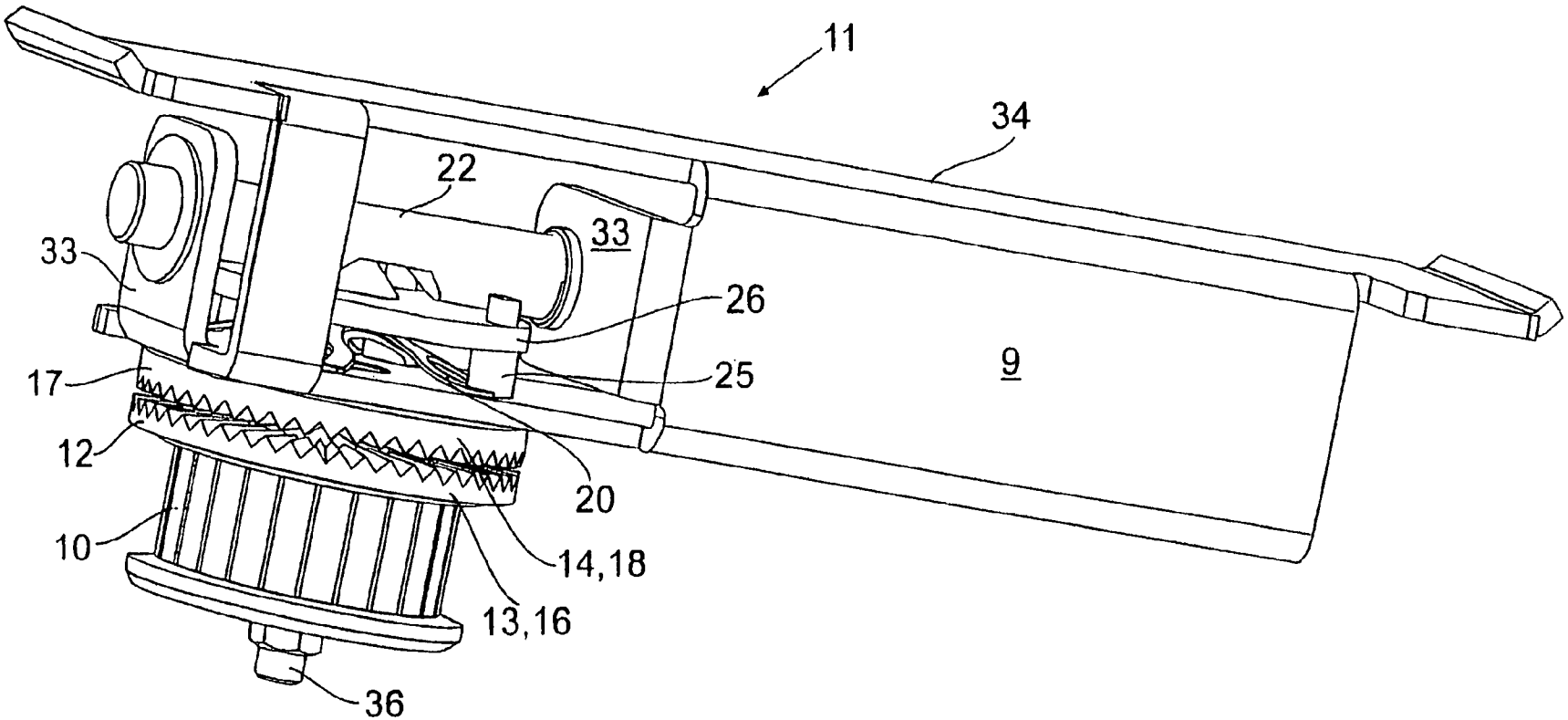
FIG. 4 shows a perspective illustration of the housing including the locking elements.

FIG. 4 corresponds to the embodiment according to FIG. 2, whereby just the compression spring 19 according to FIG. 2 is replaced by a leaf spring 20.

What is claimed is:

1. A drive device in combination with a sliding door system comprising at least one door leaf guided along a transom, the drive device comprising:

a housing mountable on the transom;

a pulley, the pulley being rotatably mounted on the housing and having a flange with locking elements, the flange having a surface facing the housing, the locking elements being adjacent to the housing and comprising teeth on the surface of the flange;

an endless traction mechanism guided around the pulley for moving the at least one door leaf linked to the traction mechanism;

complementary locking elements movable relative to the housing to engage the locking elements on the flange and thereby prevent rotation of the pulley;

an electromechanical actuation device which moves the complementary locking elements toward the locking elements in response to an impulse emitted by a locking control, the electromechanical actuation device comprising a push rod and a locking bolt supported by the housing and displaceable by the push-rod;

an axially movable toothed disc having mating teeth which form the complementary locking elements; and compression springs urging said toothed disc to abut against the housing;

wherein the toothed disc is movable toward the flange of the pulley against forces of the compression springs.

2. The drive device of claim 1, wherein, when the at least one door leaf is unlocked relative to the transom, the toothed disc abuts against an outside wall of the housing creating a gap between the mating teeth of the toothed disc and the teeth of the pulley.

3. The drive device of claim 2, further comprising a thrust plate in the housing, and connecting tenons displaceably passing through the outside wall of the housing and fixing the toothed disc relative to the thrust plate.

4. The drive device of claim 3, wherein the compression springs are disposed between the thrust plate and an inside surface of the outside wall of the housing.

5. The drive device of claim 4, wherein each of the compression springs comprises a coil spring surrounding a respective one of said connecting tenons.

6. The drive device of claim 4, wherein the compression springs comprise a leaf spring.

7. The drive device of claim 3, wherein the push-rod of the electromechanical actuation device is fixed to the locking bolt, the push-rod and the locking bolt being coaxial with respect to each other, the thrust plate and the locking bolt cooperating so that an axial movement of the locking bolt causes a movement of the thrust plate in a direction which is perpendicular to the axial movement of the locking bolt.

8. The thrust plate of claim 7, wherein the locking bolt has a recess having a slide ramp, the drive device further comprising a slide block having a complementary slide ramp, the slide block being received in the recess with the complementary slide ramp facing the slide ramp of the recess when the at least one door leaf is unlocked relative to the transom.

9. The drive device of claim 1, wherein, the electromechanical actuation device uses an electromagnet to electromagnetically actuate the push-rod, the drive device further comprising a spring disposed between the housing and the locking bolt, the spring urging the locking bolt toward an initial position of the locking bolt.

10. The drive device of claim 1, wherein the electromechanical actuation device comprises an electric motor.

11. A drive device for a sliding door system comprising at least one door leaf guided along a transom, the drive device comprising:

a housing mountable on the transom;

a pulley, the pulley being rotatably mounted on the housing and drivable in rotation, the pulley being mounted for rotation on the housing and having a flange with locking elements, the locking elements being adjacent to the housing;

an endless traction mechanism guided around the pulley for moving the at least one door leaf linked to the traction mechanism;

complementary locking elements movable relative to the housing to engage the locking elements on the flange and thereby prevent rotation of the pulley; and an electromechanical actuation device which moves the complementary locking elements toward the locking elements in response to an impulse emitted by a locking control;

wherein the electromechanical actuation device comprises a push rod and a locking bolt supported by the housing and displaceable by the push-rod, the drive device further comprising compression springs urging a toothed disc comprising the complementary locking elements to abut against the housing, the toothed disc being movable toward the flange of the pulley against forces of the compression springs.

12. The drive device of claim 11, wherein, when the at least one door leaf is unlocked relative to the transom, the toothed disc abuts against an outside wall of the housing creating a gap between the complementary locking elements of the toothed disc and the locking elements of the driven pulley.

13. The drive device of claim 12, further comprising a thrust plate in the housing, and connecting tenons displaceably passing through the outside wall of the housing and fixing the toothed disc relative to the thrust plate.

14. The drive device of claim 13, wherein the compression springs are disposed between the thrust plate and an inside surface of the outside wall of the housing.

15. The drive device of claim 14, wherein each of the compression springs comprises a coil spring surrounding a respective one of said connecting tenons.

16. The drive device of claim 14, wherein the compression springs comprise a leaf spring.

17. The drive device of claim 13, wherein the push-rod of the electromechanical actuation device is fixed to the locking bolt, the push-rod and the locking bolt being coaxial, with respect to each other the thrust plate and the locking bolt cooperation so that an axial movement of the locking bolt causes a movement of the thrust plate in a direction which is perpendicular to the axial movement of the locking bolt.

18. The drive device of claim 17, wherein the locking bolt has a recess having a slide ramp, the thrust plate comprising a slide block having a complementary slide ramp, the slide block being received in the recess with the complementary slide ramp facing the slide ramp of the recess when the at least one door leaf is unlocked relative to the transom.

19. The drive device of claim 11, wherein, the electromechanical actuation device uses an electromagnet to electromagnetically actuate the push-rod, the drive device further comprising a spring disposed between the housing and the locking bolt, the spring urging the locking bolt toward an initial position of the locking bolt.

* * * * *